United States Patent [19]

Fitzpatrick

[11] 4,173,852

[45] Nov. 13, 1979

[54] EXPANDABLE TOOL INCLUDING CUTTING SECTION AND PILOT

[75] Inventor: Paul Fitzpatrick, Southfield, Mich.

[73] Assignee: Ex-Cell-O Corporation, Troy, Mich.

[21] Appl. No.: 913,612

[22] Filed: Jun. 8, 1978

[51] Int. Cl.[2] ..... B24B 5/00

[52] U.S. Cl. ..... 51/355; 51/380

[58] Field of Search ..... 51/338, 339, 340, 343, 51/346, 350, 355, 363, 372, 380; 82/44; 242/72.1; 269/48.1; 279/2 R

[56] References Cited

U.S. PATENT DOCUMENTS

| | | | |
|---|---|---|---|
| 661,282 | 11/1900 | Bachman | 51/380 |
| 1,733,827 | 10/1929 | Seiler | 408/200 |
| 2,401,215 | 5/1946 | Anderson | 51/343 |
| 3,195,282 | 7/1965 | Magsig | 51/355 X |

*Primary Examiner*—Gary L. Smith

*Assistant Examiner*—Robert P. Olszewski

*Attorney, Agent, or Firm*—Reising, Ethington, Barnard, Perry & Brooks

[57] ABSTRACT

A rotatable cutting tool (10) of the disclosure includes an expandable cutting section (40) and a leading end having an expandable pilot (16) for properly aligning the tool during use. The trailing end of the tool preferably also has an expandable pilot (18) for aligning the tool during movement back through a bore which has been machined. A unitary body (20) of the tool has a helical slot (24) extending axially therethrough and has an inner tapered surface (26) for mounting the tool on a tapered arbor (12) such that movement therealong by nuts (34, 36, 38) engaged with axial end surfaces of the pilots controls the size of the cutting section and the pilots. The expandable tool construction is particularly adaptable for abrasion tools and is disclosed with abrasive particles (22) secured to the cutting section.

6 Claims, 2 Drawing Figures

EXPANDABLE TOOL INCLUDING CUTTING SECTION AND PILOT

TECHNICAL FIELD

This invention relates to an expandable tool including a cutting section and a pilot for aligning the tool as the tool is rotated and moved axially through a bore.

BACKGROUND ART

Prior art patents disclose expandable cutting tools having a pilot that aligns the tool as it is rotated and axially inserted within a bore to be machined. For example, the U.S. Pat. No. of Seiler 1,733,827 discloses a reamer having a pilot with tapered flutes that provide tool alignment as the tool is rotated and moved axially through a bore to be machined. Likewise, the U.S. Pat. No. of Fear 2,439,968 discloses an expandable reamer whose forward end includes a helical cutting edge of a tapered shape that aligns the tool as it is rotated and moved axially within a bore to be machined. Also, the U.S. Pat. No. of Sunnen 2,580,328 discloses an expandable honing tool having stones that are movable radially between tapered pilots at the leading and trailing ends of the tool.

DISCLOSURE OF THE INVENTION

An object of the present invention is to provide an improved expandable cutting tool for machining a bore upon tool rotation and axial movement through the bore, and wherein the tool includes an expandable cutting section and an expandable pilot that are adjustable to machine the bore to the required size and provide tool alignment during the machining.

In carrying out the above object and other objects of this invention, the tool includes a cutting section having a cylindrical cutting portion and a tapered cutting portion of a frustoconical shape whose large end is located adjacent the cylindrical cutting portion and whose small end is located adjacent the pilot at the leading end of the tool. The pilot includes a tapered surface of a frustoconical shape that extends away from the cutting section and also includes a cylindrical surface which is located between its tapered surface and the tapered cutting portion of the cutting section. The cylindrical surface of the pilot has a diameter which is larger than the diameter of the small end of the tapered cutting portion of the cutting section and slightly smaller than the diameter of the cylindrical cutting portion of the cutting section. Such a tool constructon provides proper tool alignment upon tool rotation and axial movement through a bore to be machined. Initial sizing of the tool and sizing thereof to compensate for wear adjusts both the cutting section and the pilot to the required size so as to machine the bore to the required size and provide proper tool alignment during the machining.

In its preferred construction, the cutting tool also includes an expandable second pilot at its trailing end and a second tapered cutting portion of the cutting section extending between the second pilot and the cylindrical portion of the cutting section. A tapered surface of the trailing pilot extends away from the cutting section and a cylindrical surface thereof is located between its tapered surface and the second tapered cutting portion of the cutting section. The cylindrical surface of the second pilot has a diameter which is large than the small end of the second tapered cutting portion of the cutting section and just slightly smaller than the diameter of the cylindrical cutting portion of the cutting section. After tool rotation and movement through the bore, the second pilot provides proper tool alignment as the tool is rotated and moved axially back through the bore. Initial sizing and wear compensation sizing adjusts the size of the trailing pilot along with the leading pilot and the cutting section so as to align the tool during the movement back through the bore that has been machined.

The expandable tool construction disclosed is particularly adaptable for use with abrasion cutting although other uses are possible. In the preferred embodiment, a unitary tool body has an outer surface on which abrasive particles are secured to provide the cutting section and has opposite ends on which the pilots are machined. An inner tapered surface of the tool body provides for mounting of the tool on a tapered arbor and a helical slot extending axially through the body allows axial tool movement along the arbor so as to control the size of the tool. Nuts threaded onto the arbor engage axially facing end surfaces of the pilots to provide the tool movement which controls the diameter of the cylindrical portion of the cutting section and the diameter of the cylindrical surface on each pilot. Initial sizing of the tool for use is thus facilitated and wear of the abrasive particles can be compensated for by tool movement along the arbor to increase the tool size along with an accompanying increase in the size of the pilots so that the pilots continue to function effectively.

The objects, features, and advantages of the present invention are readily apparent from the following description of the best mode for carrying out the invention taken in connection with the accompanying drawings.

BEST MODE FOR CARRYING OUT THE INVENTION

Figure 1:
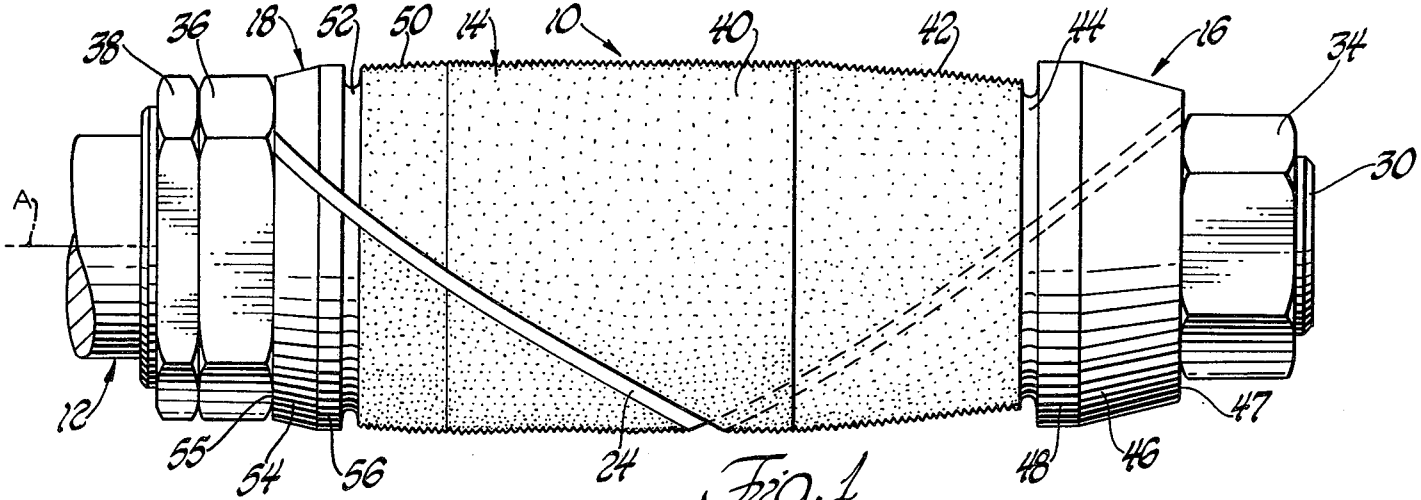
FIG. 1 is a full-bodied sid view of a rotatable cutting tool constructed according to the present invention and shown mounted on a rotatable tool arbor.

An expandable cutting tool constructed according to the present invention is indicated by reference numeral 10 in the drawings and is shown mounted on a tapered arbor 12 for rotation about an axis A to provide machining of a bore upon axial tool movement through the bore. Cutting tool 10 includes an expandable cutting section 14, an expandable pilot 16 at the leading end of the tool, and an expandable pilot 18 at the trailing end of the tool.

Figure 2:
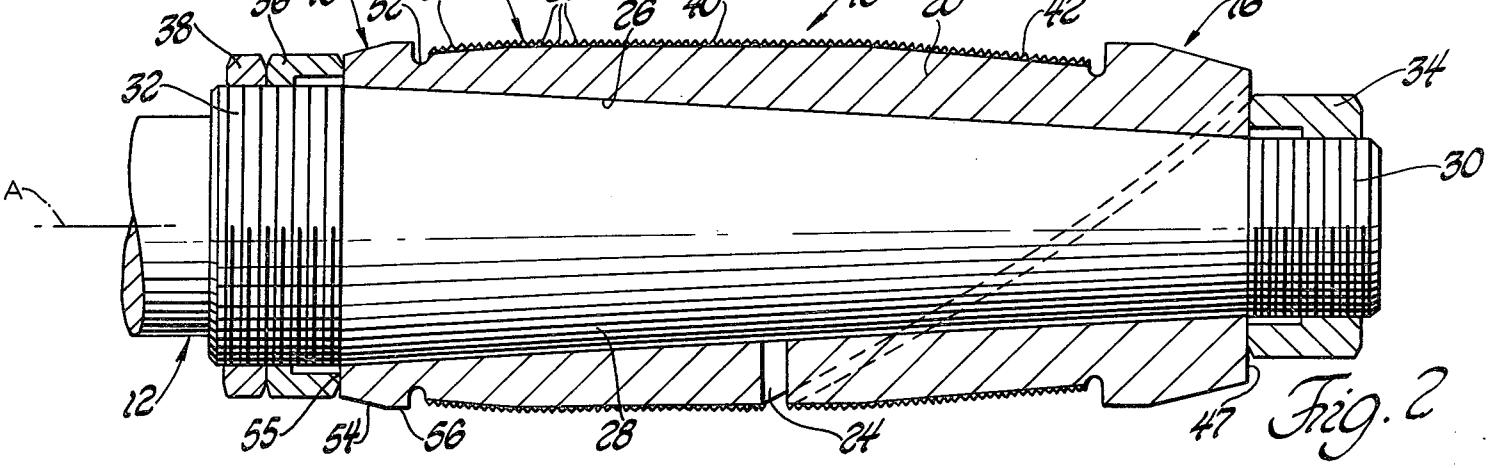
FIG. 2 is a side view of the tool taken in the same direction as FIG. 1 but with the tool shown in section so as to illustrate the tapered shape of the arbor on which the tool is designed to be mounted.

As seen best in FIG. 2, the cutting tool 10 includes a unitary tool body 20 that is made from a suitable metal such as steel. An outer surface on the tool body 20 has abrasive particles 22 such as diamond or borazon secured thereto in a suitable manner such as by plating. Both the leading and trailing pilots 16 and 18 are machined on the opposite ends of the tool body 20 and have similar constructions which will be hereinafter described. A helical slot 24 through the tool body 20 extends axially between the opposite ends thereof and between the outer surface where the abrasive particles 22 are secured and an inner tapered surface 26 of a frustoconical shape which is engaged with a tapered surface 28 of a frustoconical shape of th arbor. First and second threaded arbor portions 30 and 32, respectively, are located at the leading and trailing ends of the tapered arbor surface 28. Threaded arbor portion 30 receives a nut 34 which is engaged with the leading end of the tool while the threaded arbor portion 32 receives a nut 36 that is engaged with the trailing end of the tool and also receives a jam nut 38 for locking nut 36. Threaded movement of the nuts 34, 36, and 38 moves the cutting tool 10 along the arbor 12 to control the size thereof as the helical slot 24 allows for tool expansion. Initial sizing of the tool to the required size for finishing a bore results in sizing of the cutting section 14 and concomitant sizing of the leading and trailing pilots 16 and 18 as well. Also, any wear of the abrasive particles 22 after a period of use can be compensated for by expanding the size of the tool so as to increase the diameter of the cutting section along with a concomitant increase in the size of both pilots.

Cutting section 14 of the tool includes a cylindrical portion 40 and a tapered cutting portion 42 of a frustoconical shape whose large end is located adjacent the right end of the cylindrical cutting portion and whose small end is located adjacent the leading pilot 16. An annular groove 44 connects the small end of the tapered cutting portion 42 with the pilot 16 and facilitates the machining of the tool construction.

Pilot 16 includes a tapered surface 46 whose pointed frustoconical shape extends toward the right away from the cutting section 14 and has an axially facing end surface 47 engaged by nut 34. Pilot 16 also includes a cylindrical surface 48 located between the tapered cutting portion 412 and the tapered pilot surface 46. Cylindrical pilot surface 48 has a diameter which is larger than the diameter of the small end of the tapered cutting portion 42 and which is slightly smaller than the diameter of the cylindrical cutting portion 40, i.e. on the order of several thousandths of an inch. During use, the tapered surface 46 and the cylindrical surface 48 cooperate to insure that the cutting section 14 is properly aligned as the tool is rotated and moved axially through a bore.

Cutting section 14 also includes a second tapered cutting portion 50 whose large end is located adjacent the left end of the cylindrical cutting portion 40 and whose small end is located adjacent the trailing pilot 18. An annular groove 52 for facilitating machining connects the tapered cutting portion 50 with the pilot 18 at the trailing end of the tool.

Pilot 18 includes a tapered surface 54 whose pointed frustoconical shape extends toward the left away from the cutting section 14 and has an axially facing end surface 55 engaged by nut 36. Pilot 18 also includes a cylindrical surface 56 located between the tapered pilot surface 54 and the adjacent tapered cutting portion 50. cylindrical surface 50 has a diameter which is larger than the diameter of the small end of the cutting portion 50 of the cutting section and which is just slightly smaller than the diameter of the cylindrical portion 40 of the cutting section, i.e. on the order of several thousandths of an inch. After tool rotation and axial movement through a bore which is thereby machined by the tool, the tool rotation continues as the tool is moved axially back through the bore and the trailing pilot 18 then provides proper alignment of the tool and prevents any malforming of the finished hole.

It should be noted that the axial distance between the cylindrical pilot surface 48 and the right end of the cylindrical portion 40 of the cutting section should be less than the length of the bore so that the pilot can function in aligning the tool.

While the best mode for carrying out the invention has herein been described in detail, those skilled in this art will appreciate various alternative designs and embodiments for practicing the present invention as defined by the following claims.

What is claimed is:

1. A rotatable cutting tool including an expandable cutting section and a leading end having an expandable pilot which expands with the cutting section; the cutting section including a cylindrical cutting portion and a tapered cutting portion of a frustoconical shape whose large end is adjacent the cylindrical cutting portion and whose small end is located adjacent the pilot, said pilot including a tapered surface of a frustoconcial shape that extends away from the cutting section, the pilot also including a cylindrical surface which is located between the tapered pilot surface and the tapered cutting portion of the cutting section, and th cylindrical surface of the pilot having a diameter which is larger than the diameter of the small end of the tapered cutting portion and slightly smaller than the diameter of the cylindrical cutting portion.

2. A cutting tool as in claim 1 wherein the cylindrical and tapered cutting portions of the cutting section include abrasive particles secured thereto so as to cut by abrasion.

3. A cutting tool as in claims 1 or 2 further including a trailing end having an expandable second pilot that expands with the cutting section, the cutting section including a second tapered portion having a frustoconical shape whose large end is located adjacent the cylindrical cutting portion and whose small end is located adjacent the trailing second pilot, the trailing second pilot including a tapered surface that extends away from the cutting section and a cylindrical surface located between the tapered surface thereof and the second tapered cutting portion of the cutting section, and said cylindrical surface of the trailing second pilot having a diameter which is larger than the diameter of the small end of the second tapered cutting portion and slightly smaller than the diameter of the cylindrical cutting portion.

4. A cutting tool as in claim 3 wherein the pilot have axially facing end surfaces for engagement with threaded nuts to move the tool along a tapered arbor to control the size thereof.

5. A rotatable cutting tool including a unitary tool body having a helical slot extending axially therethrough and an inner tapered surface for mounting the tool on a tapered arbor such that axial movement therealong controls the size of the tool, said tool body having a cutting section with abrasive particles secured thereto and a leading end having a pilot, the cutting section including a cylindrical cutting portion and a tapered cutting portion of a frustoconical shape whose large end is located adjacent the cylindrical cutting portion and whose small end is located adjacent the pilot, the pilot including a tapered surface of a frustoconical shape that extends away from the cutting section, the pilot also including a cylindrical surface which is located between the tapered pilot surface and the tapered cutting portion of the cutting section, and the cylindrical surface of the pilot having a diameter which is larger than the diameter of the small end of the tapered cutting portion and slightly smaller than the diameter of the cylindrical cutting portion.

6. a rotatable cutting tool including a unitary tool body having a helical slot extending axially therethrough and an inner tapered surface for mounting the tool on a tapered arbor such that axial movement therealong controls the size of the tool, said tool body having leading and trailing ends which respectively include first and second pilots, the tool body also having an intermediate cutting section located between the pilots and including abrasive particles secured thereto, the cutting section including a cylindrical cutting portion and first and second tapered cutting portions of frustoconical shapes whose large ends are located adjacent opposite ends of the cylindrical cutting portion and whose small ends are respectively located adjacent the first and second pilots, each pilot including a tapered surface of a frustoconical shape and a cylindrical surface which is located between the tapered pilot surface thereof and the adjacent tapered cutting portion of th cutting section, and the cylindrical surface of each pilot having a diameter which is larger than the diameter of the small end of the adjacent tapered cutting portion and slightly smaller than the diameter of the cylindrical cutting portion.

* * * * *

UNITED STATES PATENT AND TRADEMARK OFFICE

CERTIFICATE OF CORRECTION

PATENT NO. : 4,173,852
DATED : November 13, 1979
INVENTOR(S) : Paul Fitzpatrick

It is certified that error appears in the above-identified patent and that said Letters Patent are hereby corrected as shown below:

Column 1, line 67, "large" should be --larger--.

Column 2, line 26, after "and" insert --any--.

Column 2, line 38, "sid" should be --side--.

Column 3, line 2, "th" should be --the--.

Column 3, line 34, "412" should be --42--.

Column 4, line 23 (Claim 1, "th" should be --the--.

Column 4, line 48 (Claim 4, "pilot" should be --pilots--.

Column 5, line 4 (Claim 6, "a" first instance, should be --A--.

UNITED STATES PATENT AND TRADEMARK OFFICE

CERTIFICATE OF CORRECTION

PATENT NO. : 4,173,852

DATED : November 13, 1979

INVENTOR(S) : Paul Fitzpatrick

It is certified that error appears in the above–identified patent and that said Letters Patent are hereby corrected as shown below:

Column 6, line 8 (Claim 6, "th" should be --the--.

Signed and Sealed this

*Eighth* Day of *April 1980*

[SEAL]

*Attest:*

SIDNEY A. DIAMOND

*Attesting Officer*

*Commissioner of Patents and Trademarks*